US007281987B2

(12) United States Patent
Iwade

(10) Patent No.: US 7,281,987 B2
(45) Date of Patent: Oct. 16, 2007

(54) PUTTER

(75) Inventor: Hirotada Iwade, Tokorozawa (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 11/090,187

(22) Filed: Mar. 28, 2005

(65) Prior Publication Data

US 2005/0215346 A1 Sep. 29, 2005

(30) Foreign Application Priority Data

Mar. 26, 2004 (JP) ..... 2004-092297

(51) Int. Cl.
*A63B 53/04* (2006.01)

(52) U.S. Cl. ..... 473/314; 473/341; 473/350

(58) Field of Classification Search ..... 473/340–342, 473/314, 350
See application file for complete search history.

(56) References Cited

U.S. PATENT DOCUMENTS 4,240,636 A * 12/1980 Swenson ..... 473/293
4,650,191 A * 3/1987 Mills ..... 473/341
4,966,369 A * 10/1990 Griffin ..... 473/313
5,441,272 A * 8/1995 Ugarte ..... 473/251
5,544,879 A * 8/1996 Collins ..... 473/314
5,755,625 A * 5/1998 Jackson ..... 473/314
5,820,481 A * 10/1998 Raudman ..... 473/313
6,176,791 B1 * 1/2001 Wright ..... 473/252
6,497,626 B1 * 12/2002 Sundberg ..... 473/248
2002/0082108 A1 * 6/2002 Peters et al. ..... 473/291
2003/0119600 A1 * 6/2003 Nelson ..... 473/340
2004/0038749 A1 * 2/2004 De La Cruz ..... 473/342
2004/0147340 A1 * 7/2004 Pokela ..... 473/340
2005/0026724 A1 * 2/2005 Deshmukh ..... 473/349
2005/0070372 A1 * 3/2005 Robbins et al. ..... 473/340

FOREIGN PATENT DOCUMENTS

JP 7-31698 A 2/1995
JP 11-57086 * 3/1999

* cited by examiner

*Primary Examiner*—Stephen Blau
(74) *Attorney, Agent, or Firm*—Sughrue Mion, PLLC

(57) ABSTRACT

It is to provide a putter adapted so that a head thereof can easily be drawn straightly backward at a back-swing. It is to locate a center G of gravity of the head more frontward (in a direction of a face side thereof than the center axis of a shaft.

7 Claims, 5 Drawing Sheets

PUTTER

BACKGROUND OF THE INVENTION

1. Field of the Invention

The present invention relates to a golf putter and, particularly, to a putter enabled to be easily drawn straightly backward at a back-swing.

2. Description of the Related Art

Recent putters, it tends to increase the depth of the center of gravity of a head as much as possible, that is, to increase a distance between a face surface and the center of gravity of the head by placing the center of gravity of the head backwardly as much as possible (refer to JP-A-7-31698, for example). Such a putter adapted to increase the depth of the center of gravity of the head has an advantage in that a sweet area thereof is enlarged by increasing the distance between the face surface and the center of gravity of the head.

SUMMARY OF THE INVENTION

In golf putting techniques, it is preferable to draw a putter head straightly backward at a back-swing. However, the aforementioned putter adapted to increase the depth of the center of gravity of the putter head is intended to enlarge the sweet area by setting the position of the center of gravity of the head as described above, but it didn't consider a relation between the position of the center of gravity thereof and the back-swing thereof.

The invention is accomplished in view of the aforementioned circumstances. Accordingly, an object of the invention is to provide a golf putter adapted by setting a position of the center of gravity of a head so that the head can easily be drawn straightly backward at a back-swing thereof.

The present inventors have performed various studies so as to solve the aforementioned problems. Consequently, the present inventors have found that in a case where the center of gravity of the head is located more frontward (in a direction of the face side thereof) than a center axis of a shaft thereof, an action of making the head move backward (in a direction of the back side thereof) at a back-swing, and that this action facilitates the putter head to be drawn straightly backward.

The invention is accomplished according to the aforementioned findings, and provides the following putters (1) to (3).

(1) A putter including: a head having a face surface; and a shaft mounted on the head, wherein a center of gravity of the head is configured to be located more frontward than a center axis of the shaft, a distance between the center axis of the shaft and the center of gravity of the head in a direction perpendicular to the face surface of the head ranges from 5 mm to 30 mm, and a distance between the center axis of the shaft and the face surface in the direction perpendicular to the face surface ranges from 3 mm to 40 mm.

(2) A putter including: a head having a face surface; and a shaft mounted on the head, wherein the head has at least a front member, which is present at a face side thereof, and a rear member, which is present at a back side thereof, the rear member is made of a material having a specific gravity, which is smaller than that of a material of which the front member is made, and a center of gravity of the head is configured to be located more frontward than a center axis of the shaft.

(3) A putter including: a head having a face surface, a back surface and a shaft mounting hole; and a shaft mounted in the shaft mounting hole of the head, wherein a ratio of a first distance between the face surface and the back surface to a second distance between the face surface and a center axis of the shaft mounting hole ranges from 1:0.3 to 1:0.7, and a center of gravity of the head is configured to be located more frontward than the center axis of the shaft.

Incidentally, in the description of the invention, the "center axis of the shaft" is defined as a center axis of the entire shaft in a case where the shaft extends straight. In a case where a leading end portion of the shaft is bent, the "center axis of the shaft" is defined as a center axis of a base-end-side portion of the shaft, which is other than the bent leading end portion thereof.

The putter according to the invention is adapted so that the center of gravity of the head is located more frontward than the center axis of the shaft. Consequently, the head can easily be drawn straightly backward at a back-swing. Thus, putting can be performed well.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Figure 1:
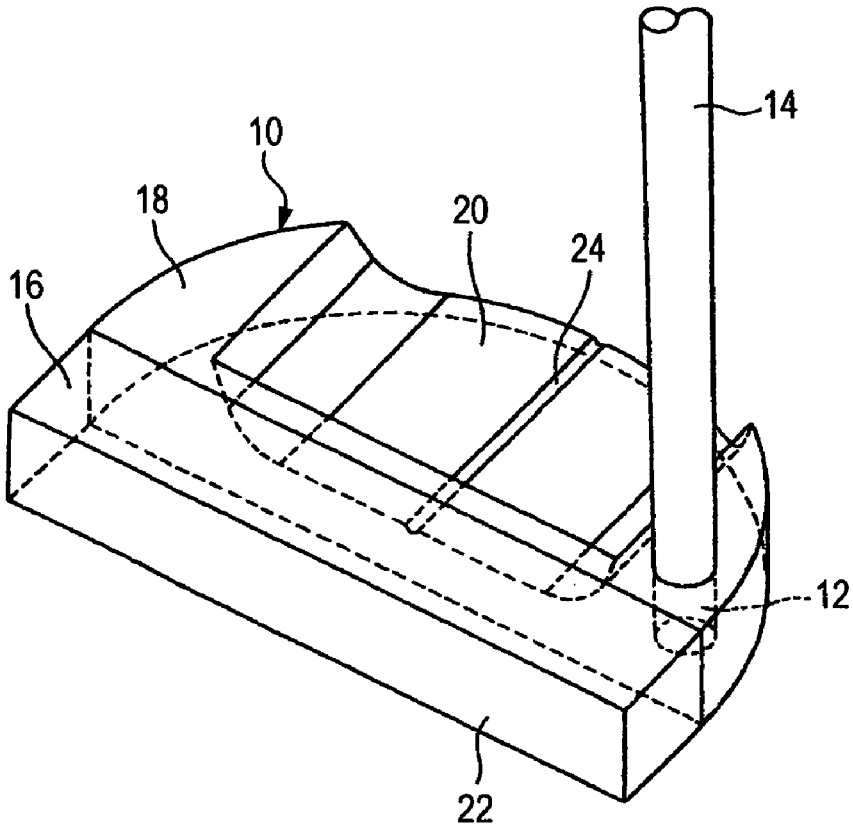
FIG. 1 is a partially omitted perspective view illustrating an example of a putter according to the invention.
Figure 2:
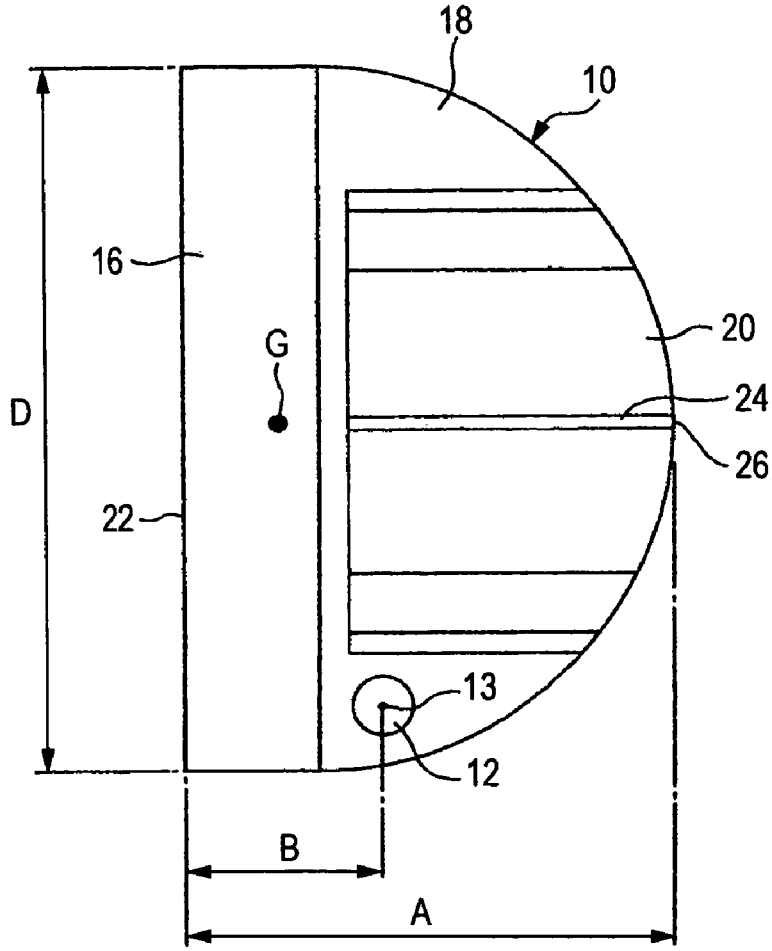
FIG. 2 is a plan view illustrating a head of the putter.
Figure 3:
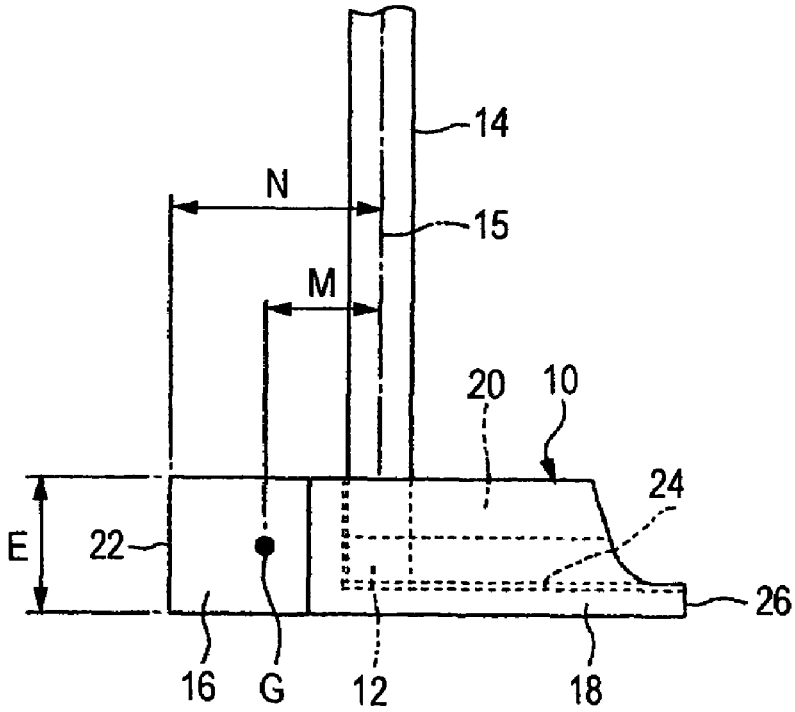
FIG. 3 is a side view illustrating the head.
Figure 4:
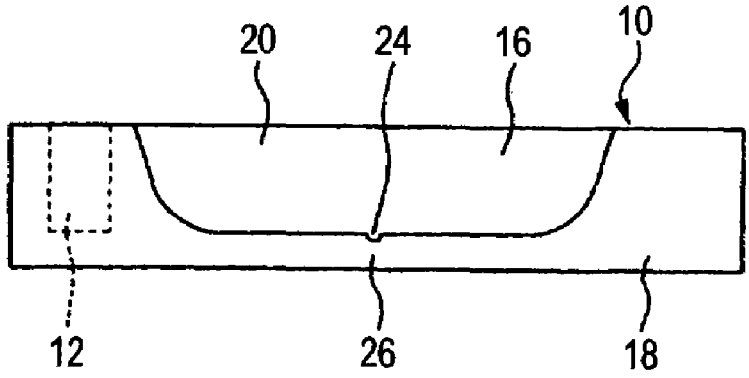
FIG. 4 is a rear view illustrating the head.

An embodiment of the invention is described hereinbelow by referring to FIGS. 1 to 4. FIG. 1 is a partially omitted perspective view illustrating an example of a putter according to the invention. FIG. 2 is a plan view illustrating a head of the putter. FIG. 3 is a side view illustrating the head. FIG. 4 is a rear view illustrating the head. In the figures, reference numeral 10 denotes a head having a shaft mounting hole 12. Reference numeral 14 denotes a shaft mounted in the shaft mounting hole 12 of the head 10.

The head 10 has a structure in which a rectangular parallelepiped front member 16 being present at a face side thereof is jointed to a semidisc-like rear member 18 being present at a back side thereof. A concave portion 20 extending from a crown to the neighborhood of a sole is provided between the neighborhood of a toe of the rear member 18 and the neighborhood of a heel thereof. A straight groove 24 being perpendicular to the face surface 22 is formed in the bottom surface of this concave portion 20.

The rear member 18 of the head 10 is made of a material, whose specific gravity is less than that of the front member 16. Concretely, the front member 16 is made of a material, such as a copper alloy and a tungsten alloy, whose specific gravity is large. The rear member 18 is made of a material, such as a fiber-reinforced resin, an aluminum alloy, and a titanium alloy, whose specific gravity is small.

In the case of the putter according to this embodiment, the ratio (A:B) of the distance A between the face surface 22 of the head 10 and a back surface 26 of the head 10 to the distance B between the face surface 22 and the center axis 13 of the shaft mounting hole 12 is set in such a way as to range from 1:0.3 to 1:0.7 (see FIG. 2). In a case where B<0.3A and where B>0.7A, when a player sets the sole in such a way as to be parallel with the ground surface and takes an address position, the shaft 14 may excessively be inclined to thereby make putting difficult. Incidentally, the position of the back surface is defined herein to be that of a rearmost end thereof.

In the putter according to this embodiment, the center G of gravity thereof is located more frontward (in the direction of the face side thereof) than the center axis 15 of the shaft 14 (see FIG. 3). In this case, the distance M in a direction perpendicular to the face surface 22 of the head 10 between the center axis 15 of the shaft 14 and the center G of gravity is set in such a way as to range from 5 mm to 30 mm, more preferably, 10 mm to 25 mm, as is seen from Table 1 listed below. In a case where the distance M is less than 5 mm, this distance M is too short so that sometimes the advantage of facilitating the head to be drawn straightly backward at a back-swing cannot be obtained. In a case where the distance M is larger than 30 mm, the shape of the head 10 causes a feeling of incongruity. Also, because the face surface 22 is placed excessively frontward of the shaft 14, sometimes, it becomes difficult to hit a ball. Incidentally, Table 1 describes results of sensory evaluations made by golfers through the use of a putter that is illustrated in FIGS. 1 to 4 and that is manufactured by setting the distance M at various values. In this case, the aforementioned distance M is adjusted by changing the position of the shaft mounting hole and bending the leading end portion of the shaft.

TABLE 1

| Distance between Shaft Center Axis and Gravity Center | Easiness of Swinging | Evaluation |
|---|---|---|
| 0 mm | Δ | No difference from ordinary putters is sensed |
| 5 mm | ○ | Back-swing is facilitated |
| 10 mm | ◎ | Back-swing is facilitated very much |
| 12 mm | ◎ | Back-swing is facilitated very much |
| 15 mm | ◎ | Back-swing is facilitated very much |
| 20 mm | ◎ | Back-swing is facilitated very much |
| 25 mm | ◎ | Back-swing is facilitated very much |
| 30 mm | ○ | Shape makes putting slightly difficult |
| 35 mm | Δ | Shape causes a feeling of incongruity |
| 40 mm | Δ | Shape causes a feeling of incongruity |
| 45 mm | Δ | Shape causes a feeling of incongruity |
| 50 mm | Δ | Shape causes a feeling of incongruity |

Further, in the case of the putter according to this embodiment, the distance N in the direction perpendicular to the face surface 22 of the head 10 between the center axis 15 of the shaft 14 and the face surface 22 is set in such a manner as to range from 3 mm to 40 mm, more preferably, 10 mm to 30 mm, as described in Table 2 listed below. In a case where the distance N is less than 3 mm, this distance N is too short so that sometimes the advantage of facilitating the head 10 to be drawn straightly backward at a back-swing cannot be obtained. In a case where the distance N is larger than 40 mm, the shape of the head 10 causes a feeling of incongruity. Also, because the face surface 22 is placed excessively frontward of the shaft 14, sometimes, it becomes difficult to hit a ball. Incidentally, Table 2 describes results of sensory evaluations made by golfers through the use of a putter that is illustrated in FIGS. 1 to 4 and that is manufactured by setting the distance N at various values. In this case, the aforementioned distance N is adjusted by changing the position of the shaft mounting hole and bending the leading end portion of the shaft.

TABLE 2

| Distance between Shaft Center Axis and Gravity Center | Easiness of Swinging | Evaluation |
|---|---|---|
| 0 mm | Δ | No difference from ordinary Putters is sensed |
| 3 mm | ○ | Although the face surface is located slightly frontward, back-swing is facilitated |
| 7 mm | ○ | Although the face surface is located slightly frontward, back-swing is facilitated |
| 10 mm | ◎ | Although the face surface is located frontward, back-swing is facilitated very much |
| 12 mm | ◎ | Although the face surface is located frontward, back-swing is facilitated very much |
| 15 mm | ◎ | Although the face surface is located frontward, back-swing is facilitated very much |
| 20 mm | ◎ | Although the face surface is located frontward, back-swing is facilitated very much |
| 30 mm | ◎ | Although the face surface is located frontward, back-swing is facilitated |
| 40 mm | ○ | Shape slightly causes a feeling of incongruity |
| 45 mm | X | Putting is difficult |
| 50 mm | X | Putting is difficult |

Figure 5:
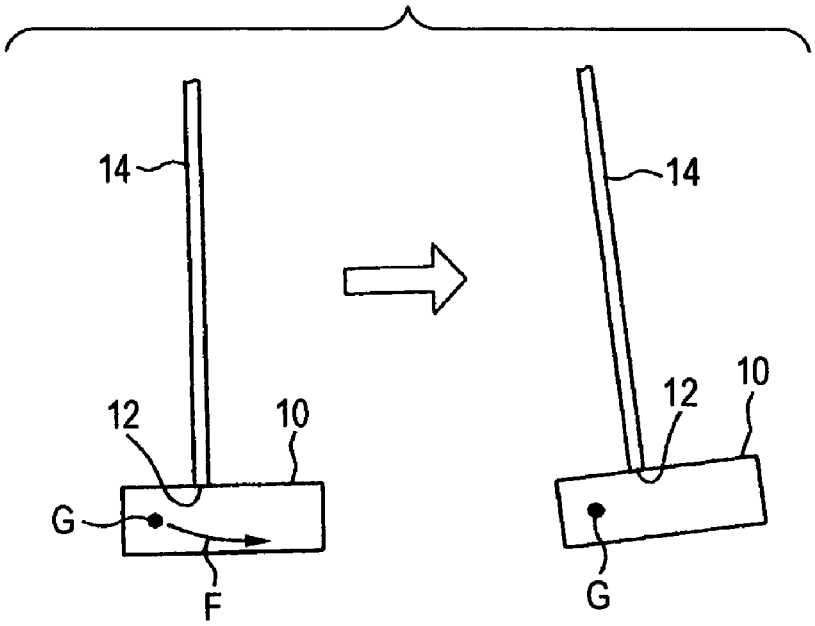
FIG. 5 is a view schematically illustrating an action of the head.

In the putter according to this embodiment, the center G of gravity of the head 10 is located more frontward of the center axis of the shaft 14. Thus, as schematically shown in FIG. 5, a force F acts in such a way as to cause the center G of gravity of the head 10 to move to the lowest point at a back-swing. This force F causes an action of making the head 10 to mover backwardly. This facilitates the head 10 of the putter according to this embodiment to be drawn straightly backward.

The putter illustrated in FIGS. 1 to 4 was manufactured. In this case, the front member 16 of the head 10 was made of a copper alloy having a specific gravity of 8.8. The rear member 18 was made of a carbon-fiber-reinforced resin having a specific gravity of 1.6. Further, the weight of the head 10 was 379 g. The ratio (A:B) of the distance A to the distance B was 1:0.4. The distance M between the center axis 15 of the shaft 14 and the center G of gravity was 14.9 mm. The distance N between the center axis 15 of the shaft 14 and the face surface 22 was 30 mm. The front-to-rear length D of the head was 100 mm. The thickness E of the face was 18 mm. This putter was adapted so that the head could easily be drawn straightly backward at a back-swing.

The putter of the invention is not limited to the aforementioned embodiment and may have the following configurations.

Figure 6:
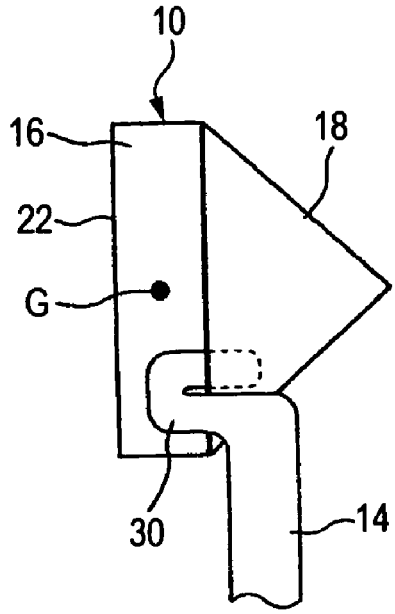
FIG. 6 is a schematic plan view illustrating an example of the putter according to the invention.

(a) As shown in FIG. 6, a portion 30 being perpendicular to the face surface 22 is provided at the leading end portion of the shaft 12. This portion 30 further facilitates the head 10 to be drawn straightly backward at a back-swing.

Figure 7:
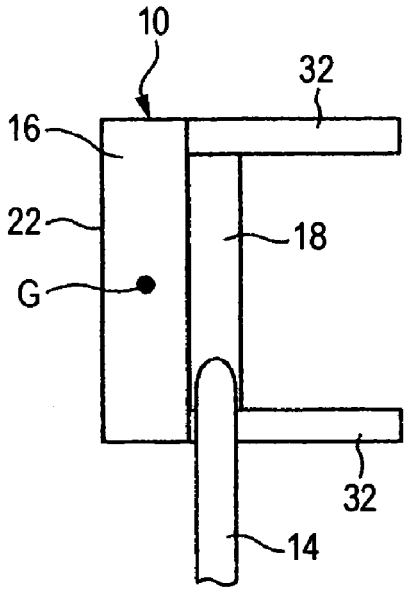
FIG. 7 is a schematic plan view illustrating an example of the putter according to the invention.

(b) As shown in FIG. 7, a pair of fins 32 being perpendicular to the face surface 22 is provided at the rear member 18. These fins 32 further facilitate the head 10 to be drawn straightly backward at a back-swing.

Figure 8:
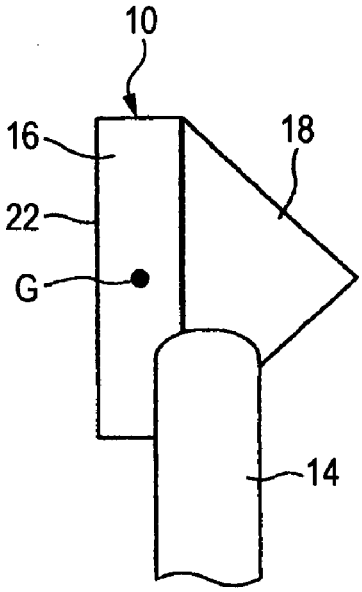
FIG. 8 is a schematic plan view illustrating an example of the putter according to the invention.

(c) As shown in FIG. 8, the shaft 14 is thickened thereby to suppress the torque thereof and to improve the directionality of the head. Thus, the head is still more facilitated to be drawn straightly backward at a back-swing. In this case, preferably, the diameter of the leading end portion of the shaft is about 15 mm to 25 mm.

(d) Although the head 10 is configured only with the front member 16 and the rear member 18 in the aforementioned embodiment, the head 10 may be configured with another member along with the members 16 and 18.

(e) Although the aforementioned embodiment is configured so that the head is configured with plural members differing in specific gravity from each other, and that the ratio (A:B) between the distances is set within a range from 1:0.3 to 1:0.7, the ratio (A:B) is not necessarily set within the range from 1:0.3 to 1:0.7 in the case that the head is configured with plural members differing in specific gravity from each other. Further, in the case that the ratio (A:B) between the distances is set within a range from 1:0.3 to 1:0.7, the head is not necessarily configured with plural members differing in specific gravity from each other. Furthermore, in the case where the distance M ranges from 5 mm to 30 mm, and where the distance N ranges from 3 mm to 40 mm, the composite constitution of the head and the ratio (A:B) between the distances are not necessarily taken into consideration.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A putter comprising:

a head having a face surface; and a shaft mounted on the head, wherein the head has at least a front member, which is present at a face side thereof, and a rear member, which is present at a back side thereof, the rear member is made of a material having a specific gravity, which is smaller than that of a material of which the front member is made, a center of gravity of the head is configured to be located more frontward than a center axis of the shaft, and the front member is made of a tungsten alloy, wherein the front member is parallelepiped and the rear member is semidisc-shaped.

2. The putter according to claim 1, wherein a concave portion extends from a crown to a sole portion of the head and between a toe and a heel of the rear member.

3. The putter according to claim 2, wherein a straight groove perpendicular to the face surface of the head extends in a bottom surface of the concave portion.

4. A putter comprising:

a head shaft having a face surface; and a shaft mounted on the head, wherein the head has at least a front member, which is present at a face side thereof, and a rear member, which is present at a back side thereof, the rear member is made of a material having a specific gravity, which is smaller than that of the material of which the front member is made, a center gravity of the head is configured to be located more frontward than a center axis of the shaft, and the rear member is made of at least one of an aluminum alloy and a titanium alloy, wherein the front member is made of at least one of a copper alloy and a tungsten alloy, wherein a whole face surface of the front member is made of the at least one of a copper alloy and a tungsten alloy.

5. A putter comprising:

a head shaft having a face surface; and a shaft mounted on the head, wherein the head has at least a front member, which is present at a face side thereof, and a rear member, which is present at a back side thereof, the rear member is made of a material having a specific gravity, which is smaller than that of the material of which the front member is made, a center gravity of the head is configured to be located more frontward than a center axis of the shaft, and the rear member is made of at least one of an aluminum alloy and a titanium alloy, wherein the front member is parallelepiped and the rear member is semidisc-shaped.

6. The putter according to claim 5, wherein a concave portion extends from a crown to a sole portion of the head and between a toe and a heel of the rear member.

7. The putter according to claim 6, wherein a straight groove perpendicular to the face surface of the head extends in a bottom surface of the concave portion.

* * * * *